US009987547B2

(12) United States Patent
Ruschkowski

(10) Patent No.: US 9,987,547 B2
(45) Date of Patent: Jun. 5, 2018

(54) MOTOR CONTROL AND REGULATING DEVICE, ESPECIALLY FOR AN ELECTRICALLY DRIVEN SKATEBOARD OR LONGBOARD

(71) Applicant: Juergen Ruschkowski, Nuremberg (DE)

(72) Inventor: Juergen Ruschkowski, Nuremberg (DE)

( * ) Notice: Subject to any disclaimer, the term of this patent is extended or adjusted under 35 U.S.C. 154(b) by 21 days.

(21) Appl. No.: 15/205,415

(22) Filed: Jul. 8, 2016

(65) Prior Publication Data

US 2017/0007910 A1 Jan. 12, 2017

(30) Foreign Application Priority Data

Jul. 10, 2015 (DE) ..... 20 2015 004 862 U

(51) Int. Cl.
*A63C 17/12* (2006.01)
*A63C 17/01* (2006.01)

(52) U.S. Cl.
CPC ..... *A63C 17/12* (2013.01); *A63C 17/015* (2013.01); *A63C 2203/12* (2013.01); *A63C 2203/18* (2013.01); *A63C 2203/24* (2013.01)

(58) Field of Classification Search
CPC ... A63C 17/12; A63C 17/015; A63C 2203/24; A63C 2203/18; A63C 2203/12
See application file for complete search history.

(56) References Cited

U.S. PATENT DOCUMENTS 6,050,357 A * 4/2000 Staelin ..... A63C 17/004 180/181
6,302,230 B1 10/2001 Kamen et al.
2005/0160902 A1* 7/2005 Iwai ..... A63B 25/08 84/723

FOREIGN PATENT DOCUMENTS

DE 100 13 009 A1 9/2001
DE 100 34 277 A1 1/2002
DE 203 08 409 U1 9/2003
DE 203 19 055 U1 7/2004
(Continued)

OTHER PUBLICATIONS

German Search Report in DE 20 2015 004 862.5 dated Jan. 29, 2016 with English translation of relevant parts.
(Continued)

*Primary Examiner* — Mussa A Shaawat
*Assistant Examiner* — Michael V Kerrigan
(74) *Attorney, Agent, or Firm* — Collard & Roe, P.C.

(57) ABSTRACT

A motor control and regulating device has a sensor system for detection of forces acting sideways on a skateboard or longboard relative to the travel direction, sensor systems for control of the rpm of an electric motor, measurement of rpm and direction of rotation of rollers of the skateboard or longboard, and detection of the turning angle of the skateboard or longboard relative to the travel direction. There is an electronic data processor with sin integrated controller, which controls the rpm and direction of rotation by processing the signals received by the sensor systems. Forces acting sideways on the skateboard or longboard are deflected into a lateral thrust force. Without an external controller, the direction of rotation of the electric motor is reversed approximately in real time when the skateboard exceeds an defined angle so it is no longer in a rolling mode but instead in a sliding mode.

20 Claims, 3 Drawing Sheets

(56) References Cited

FOREIGN PATENT DOCUMENTS

| | | |
|---|---|---|
| DE | 600 26 522 T2 | 10/2006 |
| DE | 20 2010 004 820 U1 | 8/2010 |
| DE | 10 2009 036 924 A1 | 2/2011 |
| DE | 10 2013 113 643 A1 | 6/2015 |

OTHER PUBLICATIONS

European Search Report in EP 16001508.7 dated Nov. 14, 2016 with English translation of relevant parts.

* cited by examiner

MOTOR CONTROL AND REGULATING DEVICE, ESPECIALLY FOR AN ELECTRICALLY DRIVEN SKATEBOARD OR LONGBOARD

CROSS REFERENCE TO RELATED APPLICATIONS

Applicant claims priority under 35 U.S.C. § 119 of German Application No. 20 2015 004 862.5 filed on Jul. 10, 2015, the disclosure of which is incorporated by reference.

BACKGROUND OF THE INVENTION

1. Field of the Invention

The invention relates to a motor control and regulating device, which is suitable especially for an electrically driven skateboard or longboard. It may have four or fewer rollers as well as a doubly suspended front axle in a special skateboard design. However, the invention is also applicable for electrically driven single wheels, so-called monowheels.

2. The Prior Art

The skateboard and the longboard are respectively a board with two axles and four wheels, in which the user can propel himself or herself by pushing with one leg. Increasingly, more skateboards are being equipped with a drive and are proving to be an alternative means of transportation. A technical challenge associated with this is the provision of suitable motor controllers.

German Patent Application No. DE 20 2010 004 820 U1 discloses a portable electronically regulated drive system characterized by the activation or deactivation of the drive by means of brakes, electric switches or sensor measured value.

German Patent Application No. DE 100 34 277 A1 discloses a motor controller that is adjustable for a particular speed range and that comprises a sensor for rpm detection and a transmitter provided on the wheel as well as a wireless remote controller or an infinitely variable switch provided on a steering rod or a control device operated by means of foot pedal.

German Patent Application No. DE 10 2009 036 924 A1 describes a skateboard in which the electric motor can be controlled by a controller designed as a pistol-grip controller, rocker controller or joystick. In addition, several electric motors can be operated individually or all together with the controller, and even forward and reverse travel can be controlled.

The use of the skateboard has been marked in recent decades by a sporting emphasis on skateboarding in connection with the manifestation of a large number of plastic pieces. Steering of the skateboard by weight shifts as well as leaps with the skateboard in connection with turning of the board and of the body of the user are common practice. The upwardly bent tip and the upwardly bent end of the deck are used for this purpose. Above all, the user must master skateboard sliding, a braking technique in which the speed of a traveling skateboard is braked by positioning the board crosswise by up to 90° relative to the travel direction so that the wheels skid over the ground and in this way brake the vehicle.

With the cited technical solutions, the freedom of movement of the rider is partly restricted. Hand-held objects such as a remote controller, for example, may limit the safety of the rider and in unfavorable cases may also contribute to crashes and injuries.

In addition, the cited controllers do not take into consideration the forces acting during skateboard sliding and during the situations occurring during stunts of the rider. Thus skilled skateboard riders are capable of transmitting momentum to the board by particular swinging movements of their body and in this way of greatly prolonging the phase up to the onset of pushing with the leg. These lateral forces acting in this way are not absorbed by the current technical solutions.

SUMMARY OF THE INVENTION

The task of the invention is therefore to provide, especially for an electrically driven skateboard or longboard, a motor control and regulating device that permits a higher degree of freedom of movement and safety for the rider, that has a lighter weight and that absorbs the laterally acting forces and amplifies those forces influencing the speed.

According to the invention, the task is accomplished by a motor control and regulating device, especially for an electrically driven skateboard or longboard, which comprises a sensor system for detection of forces acting sideways on the skateboard or longboard relative to the travel direction, a sensor system for control of the rpm of an electric motor, a sensor system for measurement of rpm and direction of rotation of non-driven passive rollers of the skateboard or longboard, a sensor for detection of the turning angle of the skateboard or longboard in relationship to the travel direction and an electronic data processor with an integrated controller, which controls the rpm and direction of rotation of the electric motor by processing of the signals received by the sensor systems.

The invention has the special benefit that forces acting sideways on the skateboard or longboard are deflected into a lateral thrust force, and so the locomotion is effectively supported. Without an external controller, a reversal of the direction of rotation of the electric motor is tripped approximately in real time by the invention as soon as the skateboard exceeds an angle defined in travel direction, and so it is no longer in a rolling mode but instead in a sliding mode. In this way, skilled riders are able to travel continuously on a plane with the skateboard or longboard without changing travel direction and without having to push off with the foot once again. Assisted by the simple handling of the skateboard or longboard equipped with the invention, the riders quickly learn the speed regulation that is possible in this way. Since the rider has complete freedom of movement in the hand and foot area, the invention also offers him or her a greater degree of safety.

One embodiment of the invention provides that the skateboard or longboard has a pressure sensor or another sensor for detection of the weight of the rider acting on the skateboard or longboard.

A preferred embodiment of the invention provides that the skateboard or longboard has a light-emitting diode visible for a rider, preferably a multi-color light-emitting diode, or another optical signal transmitter for signaling of information about the operating condition of the skateboard or longboard.

Preferably, the motor control and regulating device has a piezo loudspeaker or another acoustic signal transmitter, which gives the rider acoustic signals about the operating condition of the skateboard or longboard.

According to a further embodiment, the rpm of the electric motor can be regulated dynamically and/or constantly even with respect to a minimum and/or maximum speed of the skateboard or longboard, and/or the controller activates the drive rollers as brake rollers when a preset speed is exceeded.

According to a particularly preferred embodiment of the invention, the direction of rotation of the electric motor is reversible as soon as the skateboard or longboard first becomes positioned crosswise by more than 90° relative to the travel direction and thereafter maintains the travel direction while turning by a further 90°.

A further particularly preferred embodiment of the invention provides that the controller, upon the turning of the skateboard or longboard by 180°, controls the rpm of the electric motor once again only when the sensor with regard to the angular position of the deck in relationship to the travel direction and the sensor with respect to the detected rpm of the non-driven passive rollers are respectively signaling stable values.

Preferably, the forces detected by an acceleration sensor and acting sideways on the skateboard or longboard are transformed by the data processing with the controller into a thrust force and into an amplification factor for the electric motor.

According to a further embodiment, the thrust force can be regulated by means of a potentiometer or another setpoint generator in communication with the controller.

Preferably, the transformation of the forces acting sideways on the skateboard or longboard into a thrust force can be turned off.

According to a further particularly preferred embodiment of the invention, the controller controls the speed of revolution of the electric motor such that, during use of the skateboard or longboard after a turn by 180° and after change of the direction of rotation of the electric motor, the freewheel gear mechanism does not produce any braking action during further travel of the skateboard or longboard.

The controller can change the direction of rotation of the electric motor when the user of the skateboard or longboard performs leaps with it or urges it into a turning movement and turns it around its longitudinal axis.

BRIEF DESCRIPTION OF THE DRAWINGS

Other objects and features of the present invention will become apparent from the following detailed description considered in connection with the accompanying drawings. It is to be understood, however, that the drawings are designed as an illustration only and not as a definition of the limits of the invention.

In the drawings, wherein similar reference characters denote similar elements throughout the several views.

DETAILED DESCRIPTION OF THE PREFERRED EMBODIMENT

Figure 1:
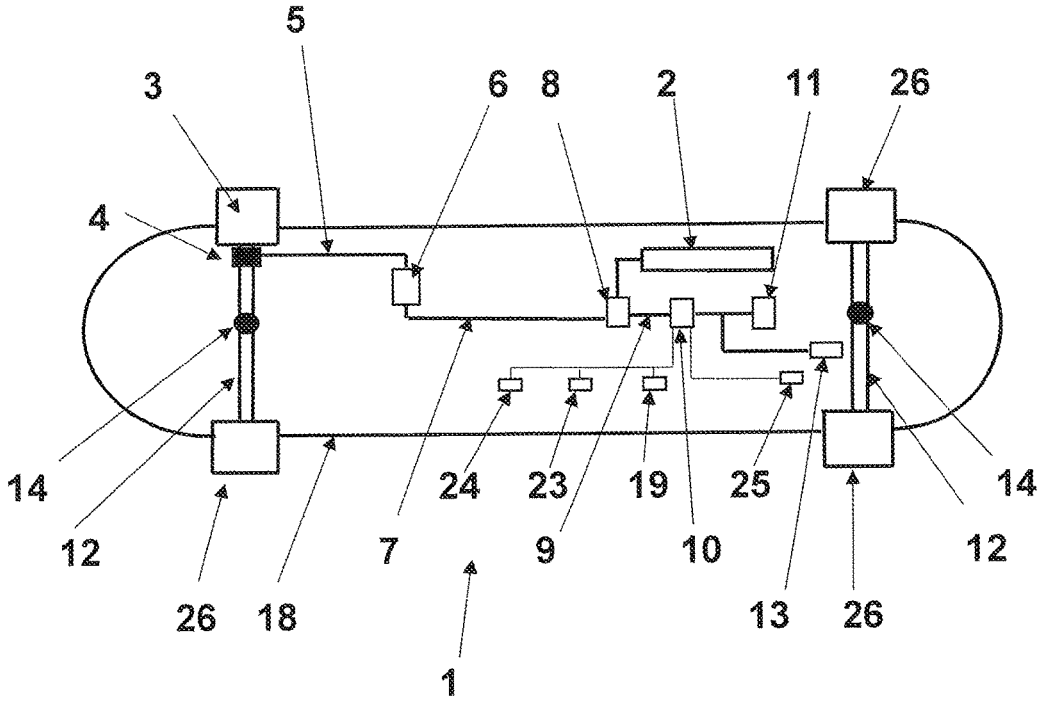
FIG. 1 shows, in schematic representation, the arrangement of components of the motor control and regulating device according to the invention on the underside of a skateboard.

Referring now in detail to the drawings, FIG. 1 shows, on an exemplary embodiment in schematic representation, the layout of components of the motor control and regulation device according to the invention disposed on the underside of the deck 18 of a skateboard. Four rollers 3, 26 disposed on the axles 12 and one freewheel gear mechanism 4 are provided in total on the deck 18 of the skateboard 1. The turned axle angle of the suspension of the axles 12 determines the steering direction and the steering angle. The electric motor 6, in this embodiment a brushless three-phase motor, is supplied with electrical energy by the accumulator 2. A battery may also be used instead of the accumulator 2.

The variant of the skateboard 1 illustrated by way of example here is equipped with the driven, so-called active roller 3 and with non-driven, so-called passive rollers 26. The drive roller 3 is mechanically in communication via a gear mechanism, a chain or a toothed belt—not illustrated here—with the electronically regulable drive system. The speed of revolution of the passive rollers 26 is measured by the sensor 13. The combined sensor 11, here the sensor with the identifier MPU-6050, combines the acceleration sensor for measurement of the drive power of the electric motor 6 and the gyro sensor for detection of the turned angle of the skateboard in relationship to the travel direction 15. The potentiometer 19 in communication with the controller 10 is provided for regulation of the lateral thrust force.

A weight sensor disposed on the upper side of the deck 18 but not illustrated here signals the "user status" upon exceedance of an adjustable measured value.

Furthermore, the LED status indicator 23, the piezo loudspeaker 24 and the display 25 are provided as a segment indicator on the deck 18 and in communication with the controller 10. It will be understood that the LED status indicator 23, the piezo loudspeaker 24 and the display 25 are disposed on the deck 18 in such a way that their signals are readily perceptible by the user.

The LED status indicator 23 is designed as a multi-color diode in the colors red/green, and with the color "green" it gives the rider of the skateboard the information that the skateboard 1 is operationally ready. However, any other optical signal transmitter may also be used. After the switching-on of the board, the MPU-6050 sensor must be initialized. This process takes approximately 20 seconds in the present example, only then is the skateboard 1 operationally ready.

As long as the LED status indicator 23 glows in the color "red", the MPU-6050 sensor is not yet initialized and consequently the board is not operationally ready. A flashing LED status indicator 23 signals a fault to the rider.

An acoustic signal notifying the completed initialization or the operational readiness can also be delivered to the rider with the piezo loudspeaker or another signal transmitter. Likewise, a warning signal about the accumulator discharge level can be delivered to him or her. Various items of information can be communicated to the rider with the segment display 25, such as, for example, the status of the accumulator 2 and the speed, the maximum, the current and the average speed, as well as the distance traveled and also particulars of the set mode of operation, such as, for example, a deactivated reversal of the motor direction of rotation.

In order to use the skateboard 1, it is first pushed by the rider. Because of the mechanical freewheel gear mechanism 4, the electric motor 6 remains passive at first. It is not simultaneously rotated. When a certain rpm is exceeded, which is detected by the sensor 13 on the passive rollers 26, the electric motor drives the mechanical linkage formed by a gear mechanism, a chain, or a toothed belt at low rpm. However, no thrust is yet exerted on the disposed active roller 3.

If the rider now moves the skateboard 1 such that sideways forces become active on the skateboard 1, the acceleration sensor 11 detects this change and the microprocessor in the controller 10 processes the received measured values into a lateral thrust force and in real time generates the resulting amplification factor for the electric device. If no lateral thrust force is being generated, the electric motor 6 stops its drive and continues to run at low rpm due to the freewheel device 4. And in the event of a drop below a certain, preset speed, the controller switches off the electric motor 6 and lapses into a standby mode.

Figure 2A:
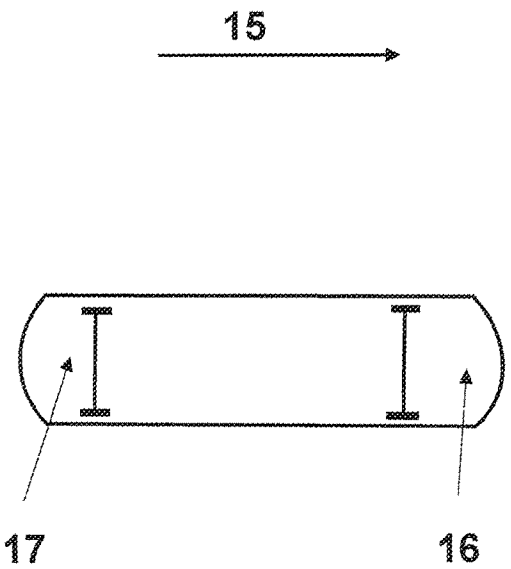
FIG. 2*a*, 2*b*, 2*c* show, in schematic representation, 3 stages of skateboard sliding.
Figure 2B:
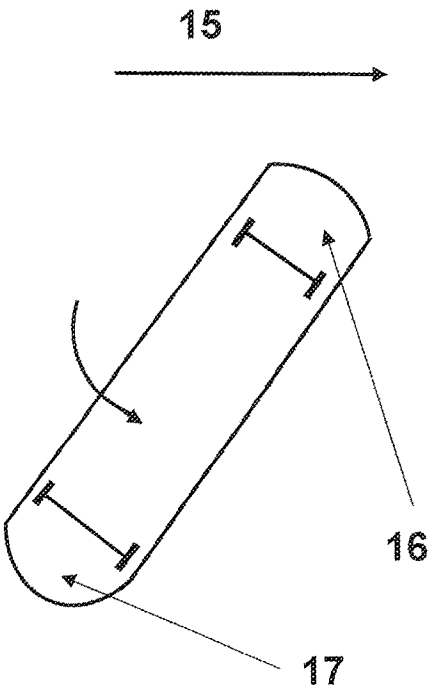
Figure 2C:
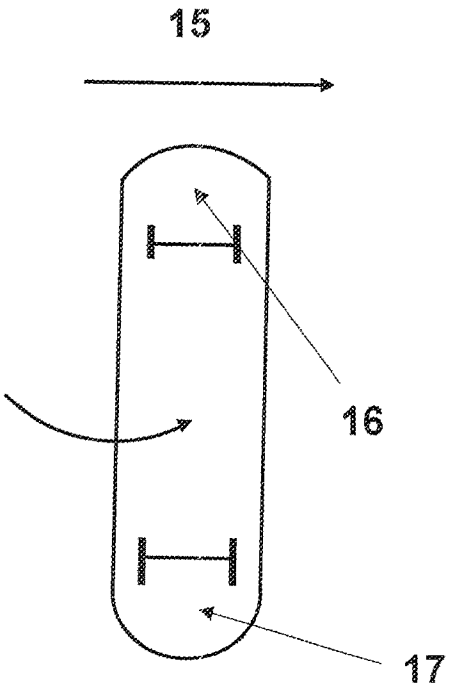

FIGS. 2*a*, 2*b* and 2*c* show the crosswise positioning of the skateboard 1 by 90° and the transition from the travel mode to the slide mode. The average turning time to turn the skateboard 1 by 90° and to bring it into the slide mode is 500 ms to 700 ms. Gyro sensor 11 recognizes this in real time via the angular position of the alignment of the deck 18 relative to the travel direction 15. In a very short time span, the electric motor 6 is braked to zero revolutions by detection of the evolving turning maneuver, the last measured speed and derived speed of motor revolution are temporarily stored and the electric motor 6 is accelerated again at high rpm in opposite direction of rotation, in order to permit optimum freewheeling when the skateboard is turned by a further 90°.

During a 180° turn of the skateboard 1, the active roller 3 and the passive rollers 26 are stopped for an instant. Only when the controller 10 has sensed stability in the values, constant or only slightly changing values, signaled respectively by the gyro sensor 11 with regard to the angular position of the deck 18 in relationship to the travel direction 15 and by the sensor 13 with respect to the rpm of the non-driven passive rollers, meaning that the sliding mode has ended, does the controller 10 again control the rpm of the electric motor 6.

This functional principle of the invention proves to be a special advantage compared with the known prior art, since this process cannot be achieved alone from the detection of the direction of rotation of the passive rollers 26 of the skateboard 1 and the speed of revolution of the passive rollers 26. Thus, when the skateboard 1 has been turned by 180° in total, it is possible to continue traveling in same travel direction as before without braking because of the high rpm of the freewheel gear mechanism. Only with the help of the gyro sensor 11, which acts as a "compass" for the skateboard and measures the change of the turning angle in real time, can it act as a trigger for the reversal of the direction of rotation of the electric motor 6.

If the skateboard is now turned once again by 180° and the sensor 13 and the gyro sensor 11 are delivering stable values, the electric motor 6 can be used as the drive once again after completion of the change of direction of rotation.

Figure 3:
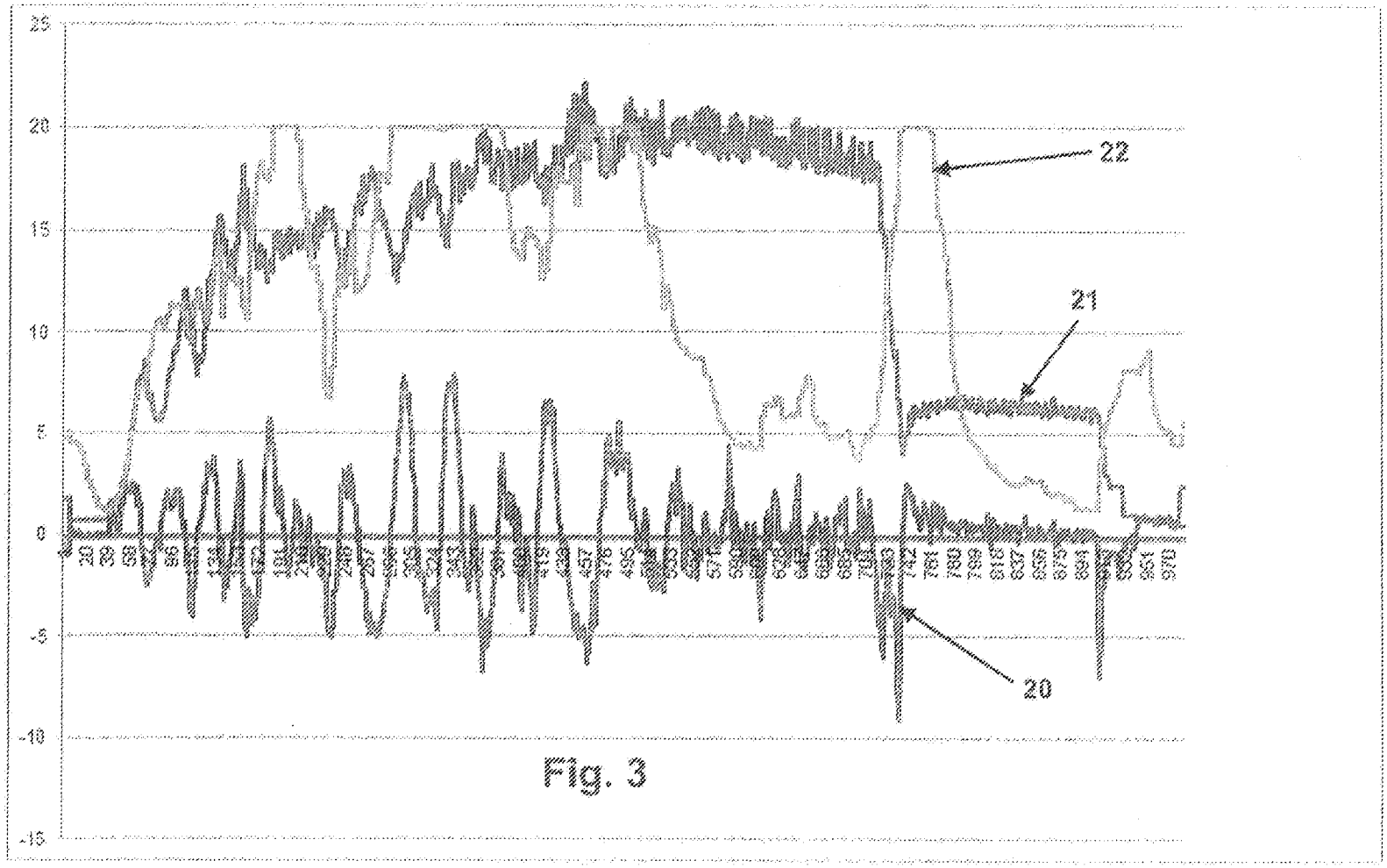
FIG. 3 shows the diagram of forces acting sideways on a skateboard and their influence on the speed of the skateboard as a function of time.

FIG. 3 shows the influence of measured lateral forces and their transformation into thrust forces on the speed over a period of approximately 30 seconds in a test run. The variation of the measured values of the lateral forces detected by the sensor 11 is illustrated in the data series 20. The data series 21 shows the variation of the speed of the skateboard 1 with a maximum speed of 22 km/h, and the data series 22 shows the calculated amplification factor. The measured values clearly show the influence of the lateral forces transformed into a thrust force up to the point when the skateboard 1 was braked toy the rider after the acceleration.

The aforesaid example is not limited to the embodiment of the invention described therein. Thus two LEDs, also multi-colored, worked into the deck and visible for the rider, can be worked in at the tip of the skateboard, in order, for example, to signal measured sideward forces to the rider by color changes or to give him or her a warning signal about a discharged accumulator or an error condition. It is also possible for more than one roller to function as active rollers 3.

With 2 piezo sensors, respectively under the front and rear axles of the skateboard, the parameters for the acceleration could be automatically adapted and specifically as a function of the weight of the rider, for longer or shorter moments of acceleration.

However, piezos can also be used as the sensor for vibrations caused by the road surface. If one of the front rollers passes over a stone, the rear roller will probably also do so shortly thereafter. Every irregularity on the road is recorded first by the first piezo in the front axle then by the second piezo in the rear axle.

Thus, similar signals (vibrations of the ground) are measured 2 times. When these vibrations are measured and the time offset is calculated as a function of the traveling speed, they can then also be analyzed and mathematically filtered out in the controller.

Vibrations caused by the road surface can also be blanked out in this way, just as the kick of the rider on the board can be detected in isolation and used as trigger signal for an operational application. For example, a single kick on the traveling skateboard may mean that the current speed is to be maintained up to the next curve or until the sensor is operated once again by the rider.

Accordingly, while only a few embodiments of the present invention have been shown and described, it is obvious that many changes and modifications may be made thereunto without departing from the spirit and scope of the invention.

What is claimed is:

1. A motor control and regulating device in combination with a skateboard or longboard having an electric motor, comprising:

a sensor system configured for detection of forces acting sideways on the skateboard or longboard relative to a travel direction;

a sensor system configured for control of rpm of the electric motor;

a sensor system configured for measurement of rpm and direction of rotation of non-driven rollers of the skateboard or longboard;

a sensor configured for detection of a turning angle of the skateboard or longboard relative to the travel direction; and an electronic data processor with an integrated controller, which controls the rpm and direction of rotation of the electric motor by processing signals received by the sensor systems, wherein the controller is configured to reverse the direction of rotation of the electric motor as soon as the skateboard or longboard first becomes positioned crosswise by more than 90° relative to the travel direction and thereafter maintains the travel direction while turning by a further 90°.

2. The motor control and regulating device according to claim 1, wherein the skateboard or longboard has a pressure sensor or another sensor configured for detection of weight acting on the skateboard.

3. The motor control and regulating device according to claim 1, further comprising a light-emitting diode or another optical signal transmitter configured for signaling of information about an operating condition of the skateboard or longboard.

4. The motor control and regulating device according to claim 1, further comprising a piezo loudspeaker or another signal transmitter configured for transmitting acoustic signals about an operating condition of the skateboard or longboard.

5. The motor control and regulating device according to claim 1, wherein the controller is configured to regulate the rpm of the electric motor with respect to a minimum or maximum speed of the skateboard or longboard, and/or the controller is configured to activate the drive rollers as brake rollers when a preset speed is exceeded.

6. A motor control and regulating device in combination with a skateboard or longboard having an electric motor, comprising:

a sensor system configured for detection of forces acting sideways on the skateboard or longboard relative to a travel direction;

a sensor system configured for control of rpm of the electric motor;

a sensor system configured for measurement of rpm and direction of rotation of non-driven rollers of the skateboard or longboard;

a sensor configured for detection of a turning angle of the skateboard or longboard relative to the travel direction; and an electronic data processor with an integrated controller, which controls the rpm and direction of rotation of the electric motor by processing signals received by the sensor systems, wherein the controller, upon the turning of the skateboard or longboard by 180°, is configured to control the rpm of the electric motor only when the sensor signals stable values with regard to an angular position of the deck relative to the travel direction and the detected rpm of the non-driven passive rollers.

7. The motor control and regulating device according to claim 6, wherein the skateboard or longboard has a pressure sensor or another sensor configured for detection of weight acting on the skateboard.

8. The motor control and regulating device according to claim 6, further comprising a light-emitting diode or another optical signal transmitter configured for signaling of information about an operating condition of the skateboard or longboard.

9. The motor control and regulating device according to claim 6, further comprising a piezo loudspeaker or another signal transmitter configured for transmitting acoustic signals about an operating condition of the skateboard or longboard.

10. The motor control and regulating device according to claim 6, wherein the controller is configured to regulate the rpm of the electric motor with respect to a minimum or maximum speed of the skateboard or longboard, and/or the controller is configured to activate the drive rollers as brake rollers when a preset speed is exceeded.

11. A motor control and regulating device in combination with a skateboard or longboard having an electric motor, comprising:

a sensor system configured for detection of forces acting sideways on the skateboard or longboard relative to a travel direction;

a sensor system configured for control of rpm of the electric motor;

a sensor system configured for measurement of rpm and direction of rotation of non-driven rollers of the skateboard or longboard;

a sensor configured for detection of a turning angle of the skateboard or longboard relative to the travel direction; and an electronic data processor with an integrated controller, which controls the rpm and direction of rotation of the electric motor by processing signals received by the sensor systems, wherein the controller is configured to control a speed of revolution of the electric motor such that a freewheel gear mechanism does not produce any braking action during further travel of the skateboard or longboard after the electric motor has changed its direction of rotation due to a turn by 180° of the skateboard or longboard.

12. The motor control and regulating device according to claim 11, wherein the skateboard or longboard has a pressure sensor or another sensor configured for detection of weight acting on the skateboard.

13. The motor control and regulating device according to claim 11, further comprising a light-emitting diode or another optical signal transmitter configured for signaling of information about an operating condition of the skateboard or longboard.

14. The motor control and regulating device according to claim 11, further comprising a piezo loudspeaker or another signal transmitter configured for transmitting acoustic signals about an operating condition of the skateboard or longboard.

15. The motor control and regulating device according to claim 11, wherein the controller is configured to regulate the rpm of the electric motor with respect to a minimum or maximum speed of the skateboard or longboard, and/or the controller is configured to activate the drive rollers as brake rollers when a preset speed is exceeded.

16. A motor control and regulating device in combination with a skateboard or longboard having an electric motor, comprising:

a sensor system configured for detection of forces acting sideways on the skateboard or longboard relative to a travel direction;

a sensor system configured for control of rpm of the electric motor;

a sensor system configured for measurement of rpm and direction of rotation of non-driven rollers of the skateboard or longboard;

a sensor configured for detection of a turning angle of the skateboard or longboard relative to the travel direction; and an electronic data processor with an integrated controller, which controls the rpm and direction of rotation of the electric motor by processing signals received by the sensor systems, wherein the controller is configured to change the direction of rotation of the electric motor when a user of the skateboard or longboard performs leaps with the skateboard or longboard, turns the skateboard or longboard around a longitudinal axis or urges the skateboard or longboard into a turning movement.

17. The motor control and regulating device according to claim 16, wherein the skateboard or longboard has a pressure sensor or another sensor configured for detection of weight acting on the skateboard.

18. The motor control and regulating device according to claim 16, further comprising a light-emitting diode or another optical signal transmitter configured for signaling of information about an operating condition of the skateboard or longboard.

19. The motor control and regulating device according to claim 16, further comprising a piezo loudspeaker or another signal transmitter configured for transmitting acoustic signals about an operating condition of the skateboard or longboard.

20. The motor control and regulating device according to claim 16, wherein the controller is configured to regulate the rpm of the electric motor with respect to a minimum or maximum speed of the skateboard or longboard, and/or the controller is configured to activate the drive rollers as brake rollers when a preset speed is exceeded.

* * * * *